US005813890A

United States Patent [19]

Benham

[11] Patent Number: 5,813,890

[45] Date of Patent: Sep. 29, 1998

[54] PIVOTING FIN WITH ELASTIC BIAS

[76] Inventor: Roger A. Benham, P.O. Box 830, San Diego, Calif. 92112

[21] Appl. No.: 909,614

[22] Filed: Aug. 12, 1997

Related U.S. Application Data

[63] Continuation-in-part of Ser. No. 712,959, Sep. 12, 1996, Pat. No. 5,664,979.

[51] Int. Cl.[6] ..... B63B 1/00

[52] U.S. Cl. ..... 441/79; 114/140

[58] Field of Search ..... 114/127–143, 39.2; 441/74, 79

[56] References Cited

U.S. PATENT DOCUMENTS

| | | | |
|---|---|---|---|
| 731,227 | 6/1903 | Royse . | |
| 3,516,100 | 6/1970 | Ellis | 9/310 |
| 3,972,300 | 8/1976 | Adamski | 114/39 |
| 4,686,922 | 8/1987 | Burroughs | 114/124 |
| 4,923,427 | 5/1990 | Roland | 446/153 |
| 5,273,472 | 12/1993 | Skedeleski et al. | 441/79 |
| 5,622,134 | 4/1997 | Kelsey | 441/79 |

FOREIGN PATENT DOCUMENTS

| | | | |
|---|---|---|---|
| 264-279-A | 4/1988 | European Pat. Off. . | |
| 2639018 | 5/1990 | France | 114/140 |
| 2738070 | 3/1979 | Germany | 114/132 |
| WO 88/09286 | 12/1988 | WIPO . | |
| WO 91/17080 | 11/1991 | WIPO . | |

*Primary Examiner*—Ed L. Swinehart
*Attorney, Agent, or Firm*—Baker & Maxham

[57] ABSTRACT

A fin assembly for mounting to a lower surface of a watercraft hull comprises a base for attachment in a fixed position to a watercraft hull lower surface, the base having first hinge pin receiving bores defining a hinge axis, a fin having an inner end having second pin receiving bores for pivotally securing to the base for pivoting about the hinge axis, and a hinge pin mounted in the first and the second hinge receiving means pivotally connecting the fin to the base, and an elastomeric member disposed between the base and the fin for resisting pivotal movement of the fin relative to the base

20 Claims, 5 Drawing Sheets

PIVOTING FIN WITH ELASTIC BIAS

REFERENCE TO RELATED APPLICATIONS

This application is a Continuation-in-Part of application Ser. No. 08/712,959 filed Sep. 12, 1996, entitled PIVOTING FIN FOR WATERCRAFT, now U.S. Pat. No. 5,664,979.

BACKGROUND OF THE INVENTION

The present invention relates to watercraft and pertains particularly to an improved fin for surfboards and other small watercraft.

Many watercraft, particularly surfboards, windsurf boards, and sailboats use a fin to resist side slip as a result of transverse forces on the craft. The transverse forces may be applied to the watercraft from many sources such as wind, traversing the slope of a wave and executing a turn. When a surfboard is traversing a wave, the fin extends into the water and helps resist and/or prevent side slip of the board on the face of the wave. Because the board is at an angle to the surface of the wave, the fin frequently has very little of its length in the water. The result is that the net effective area of the fin is decreased.

When a conventional fixed fin surfboard is turning, as illustrated in FIG. 1, the rail toward the turn (left) dips down and the board 12 is tilted resulting in the fin 14 extending at an angle to the water surface and presenting less area to resist lateral forces. This results in the fin becoming less effective in resisting the lateral forces. The effective area of the fin can be expressed by the formula n=d sine $\phi$. Where n is a major component of the area of the fin, d is depth or length of the fin and $\phi$ is the angle of the fin. Thus, the effective area component n of the fin is decreased when the board is in a turn making it less effective in the turn. The force F on the fin is directly proportional to the effective fin area and is therefore reduced when in a turn. The same thing occurs when a sailboard or sailboat keels over under the force of the wind.

In my aforementioned parent application, I disclose a pivoting fin that has a spring for biasing or urging the fin back to a center position. This fin has certain advantages in certain situations in that the deflection of the fin is related to the lateral force on the fin and the strength of the spring. I have discovered that a spring constructed of an elastomeric material has unexpected properties and benefits.

It is, therefore, desirable to have a fin that is enabled to pivot and have improved elastomeric spring means to urge it back to its neutral position.

SUMMARY OF THE INVENTION

It is a primary object of the present invention to provide a pivoting fin that is easier and simpler to manufacture and has improved resistance to corrosion.

In accordance with a primary object of the present invention, a watercraft fin is provided with elastomeric biased hinge means to enable the fin to pivot and remain highly effective during tilting or heeling of the craft about its longitudinal axis.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENTS

Figure 2:
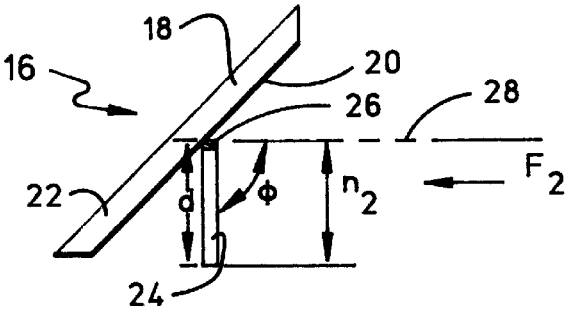
FIG. 2 is a view like FIG. 1 of a preferred embodiment of the present invention.

Referring now to FIG. 2 of the drawings an exemplary preferred embodiment of the present invention is illustrated and designated generally by the numeral 16. As illustrated, a surfboard 18 forms a three-dimensional buoyant body for supporting another body, such as a human body, on a body of water. The surfboard is a special form of a water craft having a hull with a bottom surface 20 formed for contact with the surface of the body of water, 28, and having a deck 22, usually somewhat planar in configuration for supporting a surfer for riding, traversing and sliding down the face of a wave in a body of water. In accordance with the present invention, a fin 24 is mounted to the undersurface 20 of the surfboard 18 with a pivot, hinging, or flexing member at 26 enabling the fin to pivot or swing through an angle Phi($\phi$) which may be on the order of up to about 90°. The axis of pivot 26 is parallel to and may be on or slightly offset from (i.e. below) the longitudinal axis of the craft.

Figure 1:
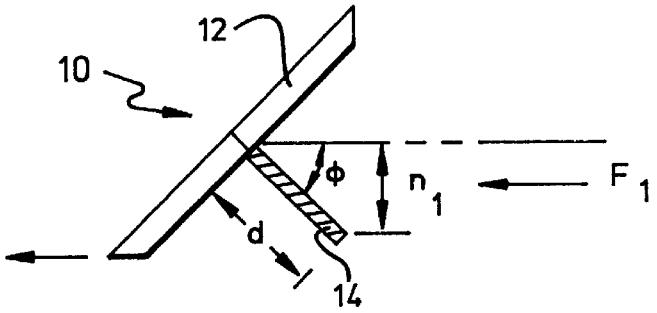
FIG. 1 PRIOR ART
FIG. 1 is a front elevation view of an exemplary prior art surfboard and fin.

The surfboard 18 is illustrated in the same position and orientation in a turn to the left as that of the conventional board of the prior art, as illustrated in FIG. 1. The board is in a turn to the left with the result that the force acting on the fin 24 is in a direction to the left, as shown by the arrow $F_2$. The arrow $F_2$ represents a force $F_2$ calculated using the major component described by the formula as described above in the background of the invention. As will be apparent from viewing FIGS. 1 and 2, the force $F_2$ for the board of the present invention will be greater than that of $F_1$ of the board of the prior art. Thus, the fin 24 in accordance with the invention provides a greater force acting on the craft 18 reacting to and resisting against the outside of the turn. The pivoting or flexing of the fin to the vertical orientation presents a larger area of it to the body of water to resist side slippage of the board.

Figure 3:
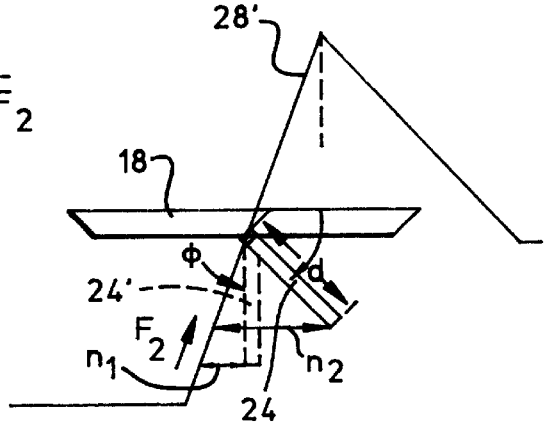
FIG. 3 is a view like FIG. 2 of the embodiment of FIG. 2 on the front side of a wave.

Referring to FIG. 3 of the drawings, the surfboard 18 is illustrated moving down but attempting traversing the front face of a wave formed by the body of water 28'. The fin 24 of the board is pivoted to the right as illustrated so that the maximum area of the board resists the lateral and downward movement of the board by the force $F_2$ of the body of water. The effective area of fin 24 is $n_2$ as opposed to $n_1$ for a fixed fin.

For the purposes of comparing with a fin of the prior art, a phantom fin 14' is illustrated extending vertically downward from the surface of the surfboard 18. As can be seen, the effective area $n_2$ on the board of the fin 24 of the present invention exceeds the effective area $n_1$ of the fin of the prior art by a considerable margin. This provides greater resistance of the surfboard 18 to lateral movement down the face of the water surface 28'.

Figure 4:
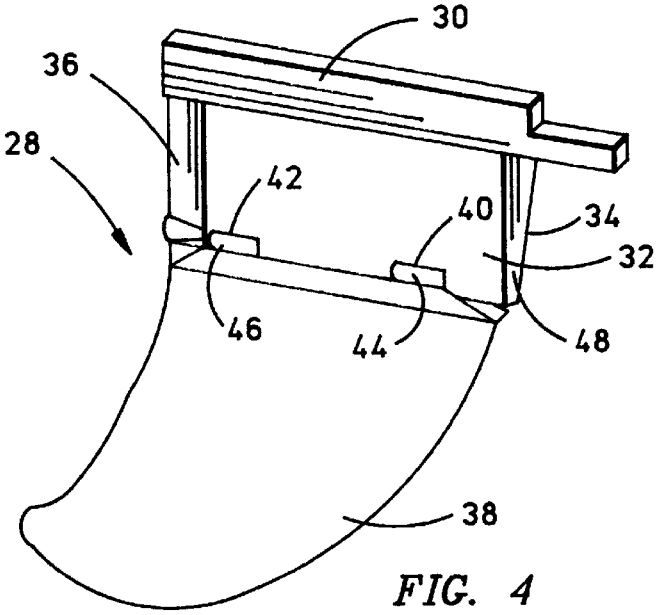
FIG. 4 is a detailed perspective view of an alternate embodiment of the invention.

Referring to FIG. 4 of the drawings, a more detailed exemplary embodiment of a surfboard fin in accordance with the invention is illustrated and designated generally by the numeral 28. The fin assembly includes a mounting base 30 adapted to fit and be mounted into a generally rectangular box-like slot or receptacle in the bottom of a surfboard. A first or fixed fin portion 32 extends from the base portion 30 typically at right angles or normal to the deck and bottom surface of the surfboard. This is a fixed section of the fin and may have a length predetermined by any number of factors, including the desired overall length of the fin. The fixed portion of the fin 32 may be sharpened, rounded or streamlined at its forward and trailing edges 34 and 36, respectively, to reduce the resistance of its movement through the water.

A pivoting fin section 38 having the usual fin configuration is pivotly hinged to the fixed member 32 at the outermost end of the hinged section. A suitable hinge structure as illustrated includes a pair of slots 40 and 42 formed in the base fin 32 for receiving a pair of projecting tabs 44 and 46 from the pivoting section 38. An aligned bore extends through the outermost section of the fixed fin portion and through the extensions 44 and 46 of the pivoting fin section 38 for receiving an elongated hinge or pivot pin 48. Suitable stop means such as abutting shoulders on the pivoting part of the fin are provided to limit the degree of pivot of the fin relative to the fixed portion 32 and to the hull surface. The pivot axis is parallel to and offset from the longitudinal axis of the craft.

Figure 5:
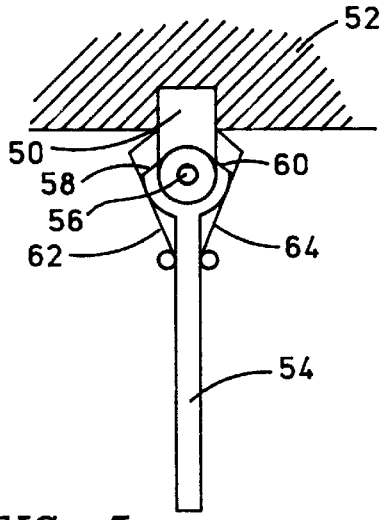
FIG. 5 is a front elevational view of a further embodiment of the invention.

Referring to FIG. 5, there is illustrated another modification of the invention wherein a base portion of the fin 50 is mounted in the usual manner in the body of a hull 52 with a pivoting fin 54 hinged as previously described at 56. The position of the hinge 56 relative to the surface of the hull varies as previously explained to provide various modifications in the effective area of the board as previously discussed. Also, multiple hinges or flex points can be used on a single fin assembly. The fin 54 includes shoulders 58 and 60 which engage side surfaces of the base member 50 for limiting the pivoting of the fin 54. These may be modified to provide any desired degree of maximum pivot from a neutral position.

An additional feature of the embodiment is the provision of resilient means in the form of opposing springs 62 and 64 which oppose the pivoting of fin 54. The resistance of the springs may be selected to obtain the desired resistance to pivoting to achieve the desired performance. The springs 62 and 64 may be of any suitable type such as leaf springs and may take any configuration. The springs are mounted or fixed at an inner end to the hull or the base of the fin and form fingers that extend along the side of the fin and engage at the outer ends with the sides of the fin.

Figure 6:
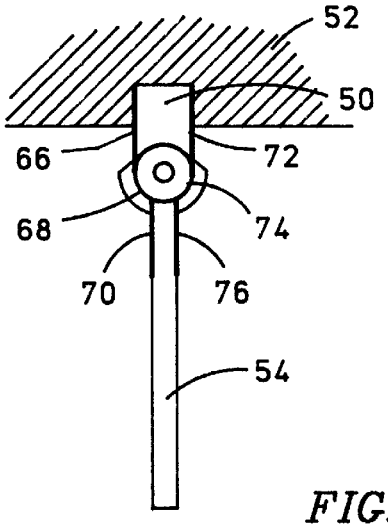
FIG. 6 is a view like FIG. 5 of another embodiment of the invention.
Figure 7:
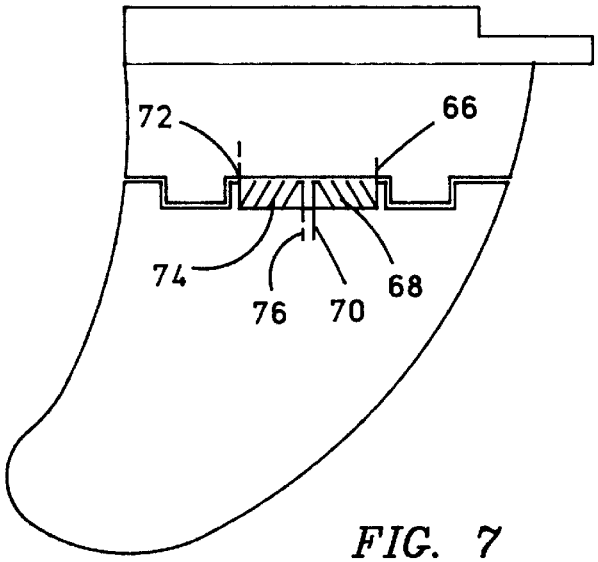
FIG. 7 is a side elevation view of the embodiment of FIG. 6.

Referring to FIGS. 6 and 7, it will also be apparent that coil springs of the torsional type may be may be utilized and mounted on or concentric with the pivot shaft 56, as shown in FIGS. 6 and 7. A pair of springs, each having an inner arm fixed to the hull or base of the fin and an outer arm engaging the side of the pivoting portion of the fin with an intermediate coil (not shown). For example, a first spring 68 has an inner arm 66 and an outer arm 70. A second spring 74 has an inner arm 72 and an outer arm 76. These outer arms bias against opposite sides of the fin biasing it to a central or neutral position.

The spring mechanism exerts a force biasing the fin toward a central position. The amount of force required to deflect the spring is determined by the spring material or spring constant. The fin is preferably normally stabilized in a central position. The degree of stiffness can be adjusted by selection of the spring stiffness. A stiffer spring renders the board more stiff. A softer spring renders the board more loose.

Figure 8:
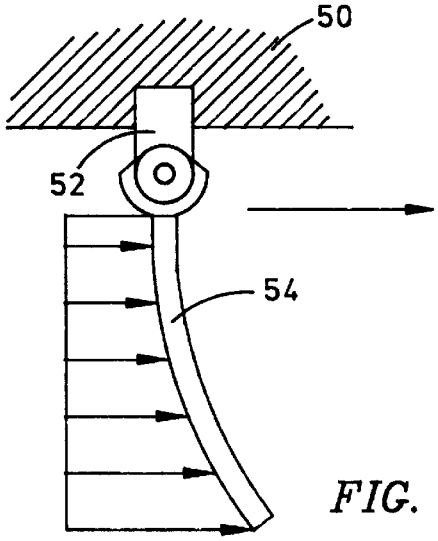
FIG. 8 is a view like FIG. 6 illustrating minor modifications.

As illustrated in FIG. 8, a certain amount of deflection may occur in the fin itself by the proper selection of stiffness of the fin material. Right or left uniform load created during a turn causes bending and deflection in accordance with traditional beam loading, equations. Thus, the stiffness of the fin as a beam can be selected to provide a desired degree of stiffness or softness. As illustrated, the deflection will be greater at the outer end. It will also be apparent that the construction of the fin may be such that it may be formed with a live hinge (i.e. a reduced thickness section). The fin may also be locked in a selected angle relative to the hull surface.

Figure 9:
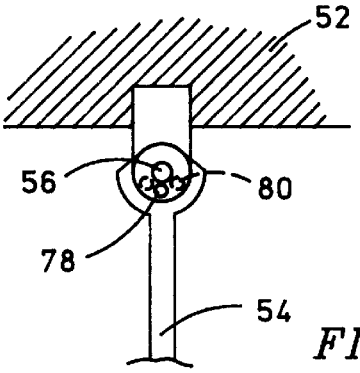
FIG. 9 is front a elevational view of a still further embodiment of the invention.
Figure 10:
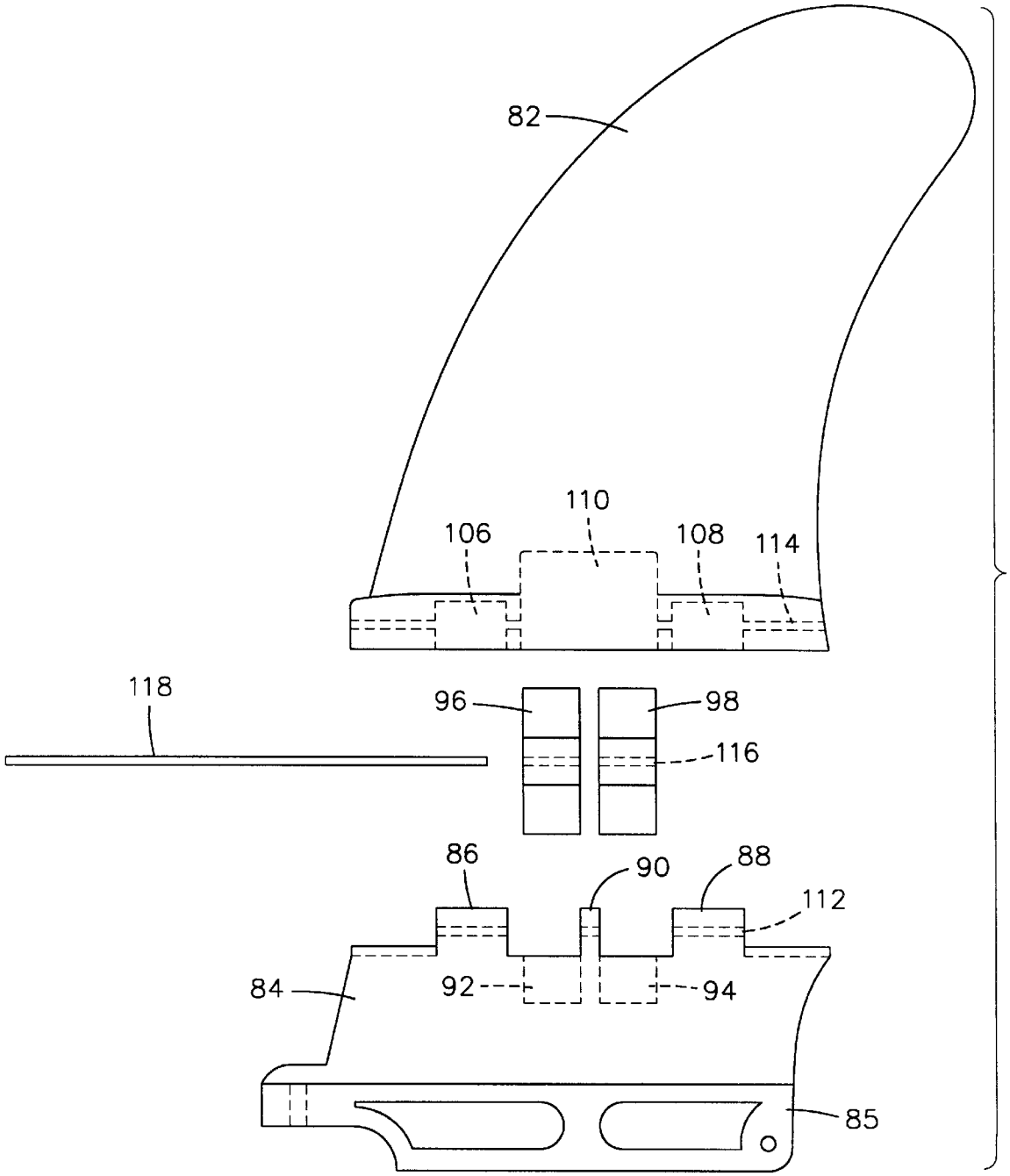
FIG. 10 is a side elevation exploded view of still another embodiment of the invention.
Figure 11:
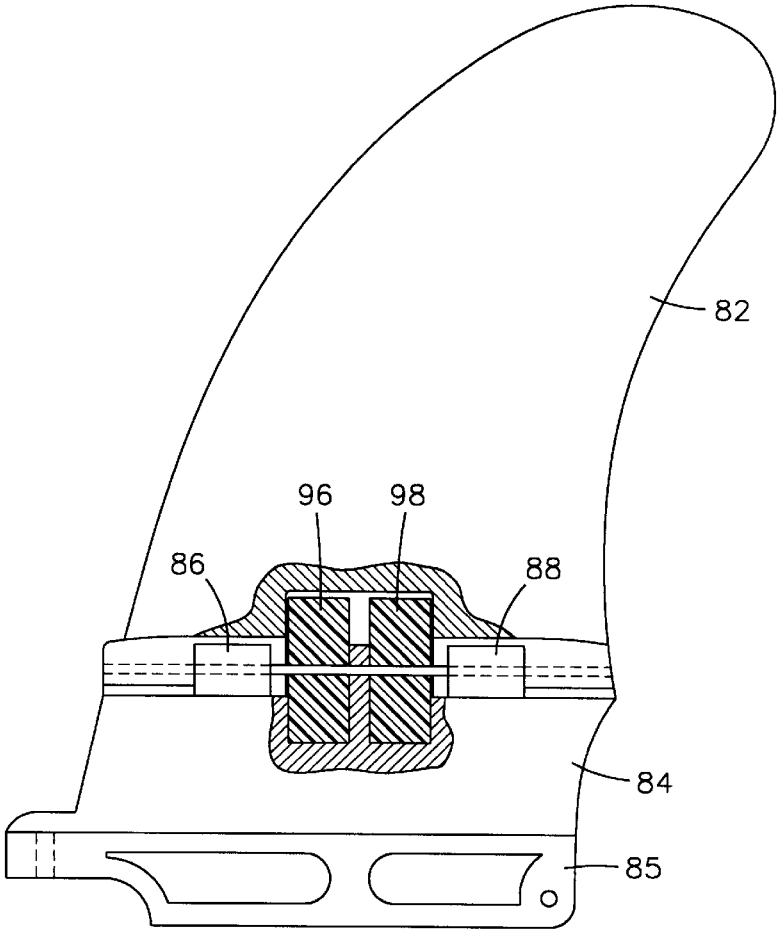
FIG. 11 is a side elevation view with portions sectioned to show details of a portion of the embodiment of FIG. 10.

Referring to FIG. 9, for example, suitable clamping arrangements or pins may be utilized to clamp or fix the fin in a selected angular position relative to the hull. For example, as seen in FIG. 9, a pin 78 may be inserted in a bore extending through fin and base portions of the hinge structure parallel and offset from the hinge pin 56. Additional holes or bores 80 may be provided in the hinge portion of the fin itself so that selected angles may be selectively locked in. This would enable setting the fin at selective angles depending on wind, wave or other conditions.

Referring to FIGS. 10–13, another resiliently pivoting fin embodiment is illustrated wherein the resilient means is an elastomeric insert. In this embodiment a pivoting fin 82 is pivotly mounted by hinge means as will be described to a base member 84. The base 84 is constructed with a plug portion 85 for extending into a generally rectangular slot or receptacle formed in the under surface of a surfboard, or other similar small watercraft for attachment of the base member in a fixed relation to the surfboard. The base 84 is formed with two large outer lugs 86 and 88, with a central smaller lug 90. A pair of cavities 92 and 94 are formed between the lugs for receiving the elastomeric biasing means. The elastomeric biasing means comprises a pair of substantially identical spring members 96 and 98. These may be the same or different in stiffness to enable greater flexibility in adjustment. It will, of course, be appreciated that it can be constructed to accept one or any number of the elastomeric biasing means.

Figure 13:
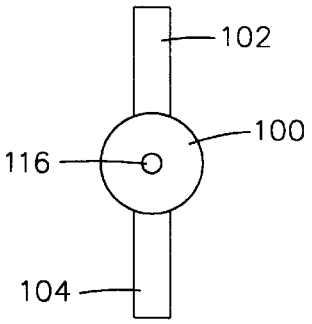
FIG. 13 is an end elevation view of the elastomeric spring of the embodiment of FIG. 10.

The elastomeric springs, as shown in FIG. 13, only one of which, 96, is illustrated and described comprises a central generally cylindrical body 100, having a pair of wings 102 and 104, which extend respectively into cavities in the base and in the fin. The spring or biasing member is preferably constructed of a neoprene rubber or other similar elastomeric material. An advantage of this construction over the prior embodiments is that it can be increased and decreased in stiffness by changing the composition of the material without changing the size of the member. This enables the stiffness of the hinge of the fin to be established by the stiffness of the elastomeric members without increasing the size or thickness of the members. The elastomeric spring is also more resistant to corrosion than metal springs.

The fin 82 is provided with the other portion of the hinge which is in the form of a pair of cavities, including a fore cavity 106 for receiving the lug 86 and an aft cavity 108 for receiving the lug 88. A central cavity 110 between the cavities 106 and 108 is designed to receive a central lug 90 and an arm of each of the elastomeric members. The elastomeric springs could be located anywhere along the pivot axis. With this construction, the resistance to pivoting of the fin is due to the resistance to bending of the elastomeric members. It will be appreciated that it could be constructed so that an elastomeric member is compressed between opposing moving surfaces so that the resistance is due to compression. However, the illustrated construction is preferred in that it allows a greater degree of pivoting movement of the fin.

A bore 112 formed in the lugs of the base align with bores 114 in the fin 82 and with a bore 116 in the elastomeric member to receive a hinge pin 118. One of the bores 112 or 114 is preferably of sufficient size to provide a loose fit to enable free pivoting of the fin with the respect to the base member 84. The bore 116 in the elastic spring members are preferably of a smaller diameter than the pin providing a tight press fit so that the hinge pin 18 is tightly gripped and retained in place in the hinge assembly.

Figure 12:
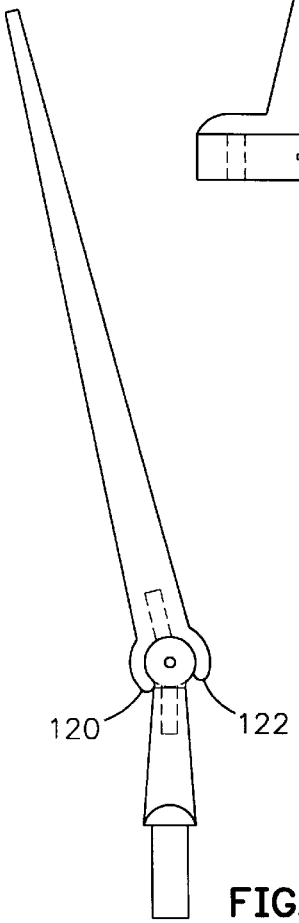
FIG. 12 is a front end elevation view of the elastomeric spring of FIG. 10.

The hinge structure of the fin, as shown in FIG. 12, is preferably formed with side shoulders 120 and 122, which act as stop members to limit the pivoting of the fin. The fin may be constructed to pivot up to approximately 90 degrees with respect to its central position on a normal board. However, it is preferably limited to a range of no more than about 45 degrees to either side of its neutral position. In practice, I have found that a 30 degree rotation in either direction seems to be adequate to provide optimum performance.

Figure 14:
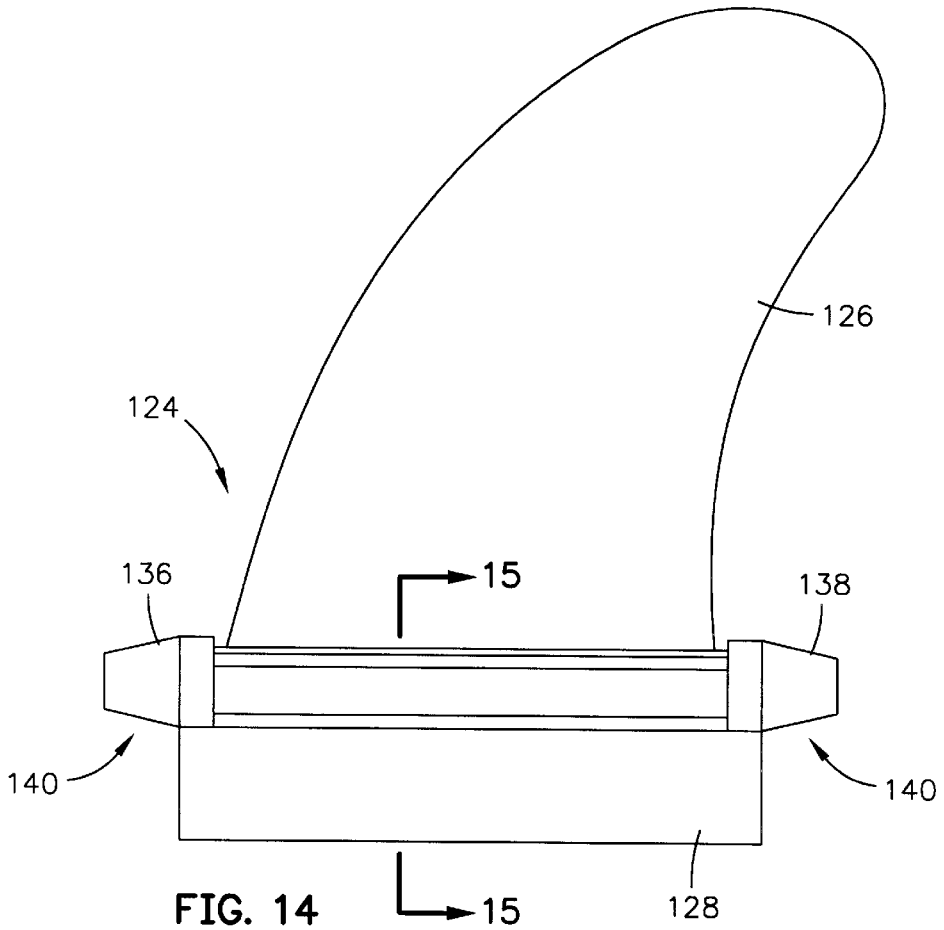
FIG. 14 is a side elevation view of a still further embodiment of the invention.
Figure 15:
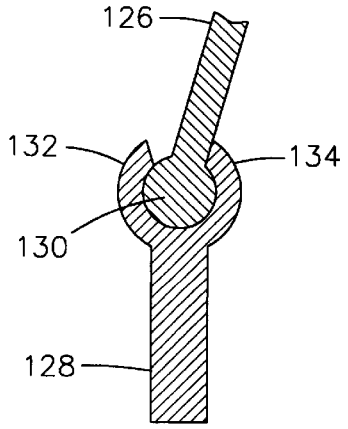
FIG. 15 is a view taken generally on line 15—15 of FIG. 14.
Figure 16:
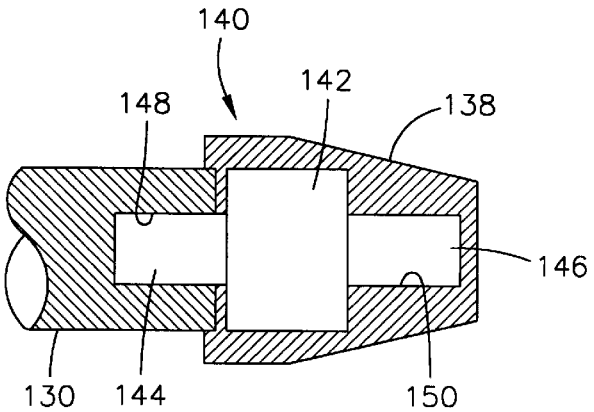
FIG. 16 is a top plan view of the elastomeric spring of the FIG. 14 embodiment.

Referring now to FIG. 14, a fin assembly designated generally at 124 comprises a fin 126 of the usual configuration pivotly mounted or hinged to a base 128 adapted to mount to the bottom of a surfboard or the like. This hinge assembly as best illustrated in FIG. 15, comprises a semi-cylindrical hinge pin 130 formed along the lower edge of the fin 126 to fit into a semi-circular slot in the base formed by a pair of curved walls 132 and 134. The base is formed with at least one end of the semi-circular slot open for receipt of the fin and a pair of cap members 136 and 138 capturing and retaining a pair of elastomeric spring members 140. The elastomeric members are substantially identical and as shown in FIG. 16 comprise a central cylindrical body member 142 with a pair of rectangular arms 144 and 146, extending axially from the central cylindrical body member. These may be the same or different in stiffness to enable greater flexibility in adjustment.

The elastomeric member arm 144 fits within a recess 148 in the end of the hinge pin 130 of the fin with the other arm 146 fitting within a similar rectangular recess 150 within one of the cap members 136 and 138. The cap members 136 and 138 may be secured to the base member 128 either permanently or detachably by suitable attachment means. For example, the caps can be attached permanently by means of a permanent glue or other bonding material or technique, such as sonic welding, snap fittings, and the like. The caps may also be attached by means of screws or bolts (not shown) to otherwise make them detachable. Alternatively, one of them may be permanently attached and the other one detachable.

The stiffness of the spring, can be adjusted as in the prior embodiments by the hardness of the elastomeric body member. In addition, it will be appreciated from FIG. 15 that the pivoting of the fin 126 is limited in its degree of pivoting by means of shoulders formed by the opening in the slot formed by the wall members 132 and 134.

While I have illustrated and described my invention by means of specific embodiments it is to be understood that numerous changes and modifications may be made therein without departing from the spirit and the scope of the invention as shown in the appended claims.

I claim:

1. A pivoting fin assembly for mounting to a lower surface of a watercraft, the fin assembly comprising:

a base for attachment in a fixed position to a watercraft hull lower surface, the base having first hinge means having pin receiving means defining a hinge axis;

a fin having an inner end having second hinge means for pivotally securing to said first hinge means on said base for pivoting about said hinge axis; and an elastomeric spring member disposed between said base and said fin for elastically biasing said fin to a central position and resisting pivotal movement of said fin from said central position relative to said base.

2. A fin assembly according to claim 1 wherein said fin is enabled to pivot at an angle up to about forty-five degrees from a neutral position.

3. A fin assembly according to claim 2 wherein said elastomeric member includes a central body and a pair of arms, one connected respectively to each of said base and said fin.

4. A fin assembly according to claim 3 wherein said arms extend into recesses in each of said base and said fin.

5. A fin assembly according to claim 3 wherein said fin assembly includes multiple ones of said elastomeric member.

6. A fin assembly according to claim 1 wherein said fin assembly includes multiple ones of said elastomeric member.

7. A fin assembly according to claim 6 wherein said hinge means includes shoulder means defining an angle of pivot of said fin.

8. A fin assembly according to claim 6 wherein:

said base includes a pair of spaced apart lugs having aligned bores defining said first hinge means; and said fin includes a pair of spaced apart recesses for receiving said lugs, said recesses including end walls having aligned bores defining said second hinge means.

9. A fin assembly according to claim 1 wherein said elastomeric member comprises a first arm connected to said fin and a second arm connected to said base.

10. A pivoting fin assembly for mounting to a lower surface of a watercraft, the fin assembly comprising:

a base for attachment in a fixed position to a watercraft hull lower surface, the base having first hinge pin receiving means defining a hinge axis;

a fin having an inner end having second hinge means for pivotally securing to said first hinge means on said base for pivoting about said hinge axis; and an elastomeric member disposed between said base and said fin for resisting pivotal movement of said fin relative to said base, wherein said elastomeric member comprises a first arm connected to said fin and a second arm connected to said base.

11. A fin assembly according to claim 10 wherein said fin includes a cavity for receiving said first arm and said base includes a cavity for receiving said second arm.

12. A fin assembly according to claim 11 wherein said elastomeric member includes a throughbore for receiving a hinge pin.

13. A fin assembly according to claim 12 wherein said hinge pin is press fitted in said bore in said elastomeric member.

14. A fin assembly according to claim 13 wherein said hinge means includes stop means for limiting pivoting of said fin to no more than about forty-five degrees from a neutral position.

15. A fin assembly according to claim 10 wherein said fin includes a cavity for receiving said first arm and said base includes a cavity for receiving said second arm.

16. A pivoting fin assembly: for mounting to a lower surface of a watercraft, the fin assembly comprising:

base for attachment in a fixed position to a watercraft hull lower surface, said base includes a pair of spaced apart lugs having aligned pin receiving bores defining a first hinge axis;

a fin having an inner end having second hinge means for pivotally securing to said first hinge means on said base for pivoting about said hinge axis;

an elastomeric member disposed between said base and said fin for resisting pivotal movement of said fin relative to said base; and said fin includes a pair of spaced apart recesses for receiving said lugs, said recesses including end walls having aligned bores defining said second hinge means.

17. A fin assembly according to claim 16 wherein said elastomeric member includes a throughbore for receiving hinge pin, and said hinge pin is press fitted in said bore in said elastomeric member.

18. A pivoting fin assembly for attachment to a lower surface of a watercraft, the fin assembly comprising:

a base for attachment in a fixed position to the lower surface of the watercraft, the base having first pair of aligned hinge pin receiving bores defining a hinge axis;

a fin having an inner end having a second pair of aligned hinge pin receiving bores for alignment with said first pair of bores;

a hinge pin mounted in said first and said second hinge receiving bores for pivotally securing said fin to said base for pivoting about said hinge axis; and an elastomeric member disposed between said base and said fin and comprising a central body having a pair of arms, said arms connected respectively to each of said base and said fin for resisting pivotal movement of said fin relative to said base.

19. A fin assembly according to claim 18 wherein said elastomeric member includes a throughbore for receiving said hinge pin, and said hinge pin is press fitted in said bore in said elastomeric member.

20. A fin assembly according to claim 19 wherein:

said base includes a pair of spaced apart lugs having aligned bores defining said first hinge pin receiving means;

said fin includes a pair of spaced apart recesses for receiving said lugs, said recesses including end walls having aligned bores defining said second hinge pin receiving means; and said elastomeric member is disposed between said lugs.

* * * * *